US008979666B2

(12) United States Patent
Hasegawa et al.

(10) Patent No.: US 8,979,666 B2
(45) Date of Patent: Mar. 17, 2015

(54) GOLF CLUB SHAFT

(75) Inventors: Hiroshi Hasegawa, Kobe (JP); Takashi Nakano, Kobe (JP); Yasushi Sugimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 217 days.

(21) Appl. No.: 13/474,233

(22) Filed: May 17, 2012

(65) Prior Publication Data

US 2012/0295734 A1 Nov. 22, 2012

(30) Foreign Application Priority Data

May 18, 2011 (JP) ..... 2011-111161

(51) Int. Cl.
*A63B 53/10* (2006.01)

(52) U.S. Cl.
USPC ..... 473/319

(58) Field of Classification Search
USPC ..... 473/292, 316–323
See application file for complete search history.

(56) References Cited

U.S. PATENT DOCUMENTS

| | | | | |
|---|---|---|---|---|
| 5,437,450 | A * | 8/1995 | Akatsuka et al. | 473/320 |
| 6,306,047 | B1 * | 10/2001 | Kusumoto | 473/319 |
| 6,926,617 | B2 * | 8/2005 | Oyama | 473/319 |
| 6,929,562 | B2 * | 8/2005 | Kumamoto | 473/319 |
| 7,338,386 | B2 * | 3/2008 | Nakajima | 473/319 |
| 7,361,098 | B2 | 4/2008 | Oyama | |
| 7,500,922 | B2 * | 3/2009 | Takeuchi | 473/319 |
| 7,524,248 | B2 * | 4/2009 | Kumamoto | 473/319 |
| 8,066,583 | B2 * | 11/2011 | Rice et al. | 473/282 |
| 8,678,945 | B2 * | 3/2014 | Rice et al. | 473/316 |
| 2009/0069109 | A1 * | 3/2009 | Kumamoto | 473/289 |
| 2010/0022324 | A1 * | 1/2010 | Kato | 473/319 |
| 2010/0041492 | A1 * | 2/2010 | Rice | |

FOREIGN PATENT DOCUMENTS

| | | | |
|---|---|---|---|
| JP | 2002-35186 | A | 2/2002 |
| JP | 2009066130 | A * | 4/2009 |
| JP | 2009-254601 | A | 11/2009 |
| JP | 2011-15830 | A | 1/2011 |

* cited by examiner

*Primary Examiner* — Stephen L. Blau
(74) *Attorney, Agent, or Firm* — Birch, Stewart, Kolasch & Birch, LLP

(57) ABSTRACT

In a shaft 6, a shaft full length is defined as Ls, and a distance between a tip end of the shaft and a center of gravity G of the shaft is defined as Lg. Lg/Ls is 0.52 or greater and 0.65 or less. A shaft weight is equal to or less than 52 g. Preferably, the shaft 6 has butt partial layers a5 and a6. When a point separated by 250 mm from a butt end Bt is defined as P2; a range from the point P2 to the butt end Bt is defined as a specific butt range; the total weight of the butt partial layers a5 and a6 existing in the specific butt range is Wa gram; and a weight of the shaft in the specific butt range is defined as Wb gram, Wa/Wb is preferably equal to or greater than 0.4.

18 Claims, 8 Drawing Sheets

GOLF CLUB SHAFT

The present application claims priority on Patent Application No. 2011-111161 filed in JAPAN on May 18, 2011, the entire contents of which are hereby incorporated by reference.

BACKGROUND OF THE INVENTION

1. Field of the Invention

The present invention relates to a golf club shaft.

2. Description of the Related Art

A golf club in which a weight ratio of a butt portion of the club is considered is proposed. Japanese Patent Application Laid-Open No. 2002-35186 discloses a golf club having a head weight equal to or greater than 175 g and a club length equal to or greater than 46 inch. When the total mass of a portion except a head is defined as A, and the mass of the butt portion between the back end of a grip and a position separated by 170 mm from the back end is defined as B, the ratio of the mass B to the total mass A is 55% or greater and 70% or less.

SUMMARY OF THE INVENTION

The weight saving of a shaft can contribute to increase of a flight distance. However, there is a limit on the weight saving of the shaft in respect of a strength. On the other hand, a coefficient of restitution, a club length, and a moment of inertia of a head are regulated by the rules. It is difficult to further improve flight distance performance in the conventional technique.

It is an object of the present invention to provide a golf club shaft capable of enhancing flight distance performance of a club.

When a shaft full length is defined as Ls and a distance between a tip end of the shaft and a center of gravity G of the shaft is defined as Lg, a ratio (Lg/Ls) is 0.52 or greater and 0.65 or less. A shaft weight is equal to or less than 52 g. Preferably, the shaft weight is equal to or less than 50 g.

Preferably, the shaft has a butt partial layer. Preferably, when a point separated by 250 mm from a butt end Bt is defined as P2; a range from the point P2 to the butt end Bt is defined as a specific butt range; a weight of the butt partial layer existing in the specific butt range is defined as Wa (g); and a weight of the shaft in the specific butt range is defined as Wb (g), a ratio (Wa/Wb) is equal to or greater than 0.4. Preferably, a fiber elastic modulus of the butt partial layer is equal to or less than 20 t/mm$^2$.

DESCRIPTION OF THE PREFERRED EMBODIMENTS

Figure 1:
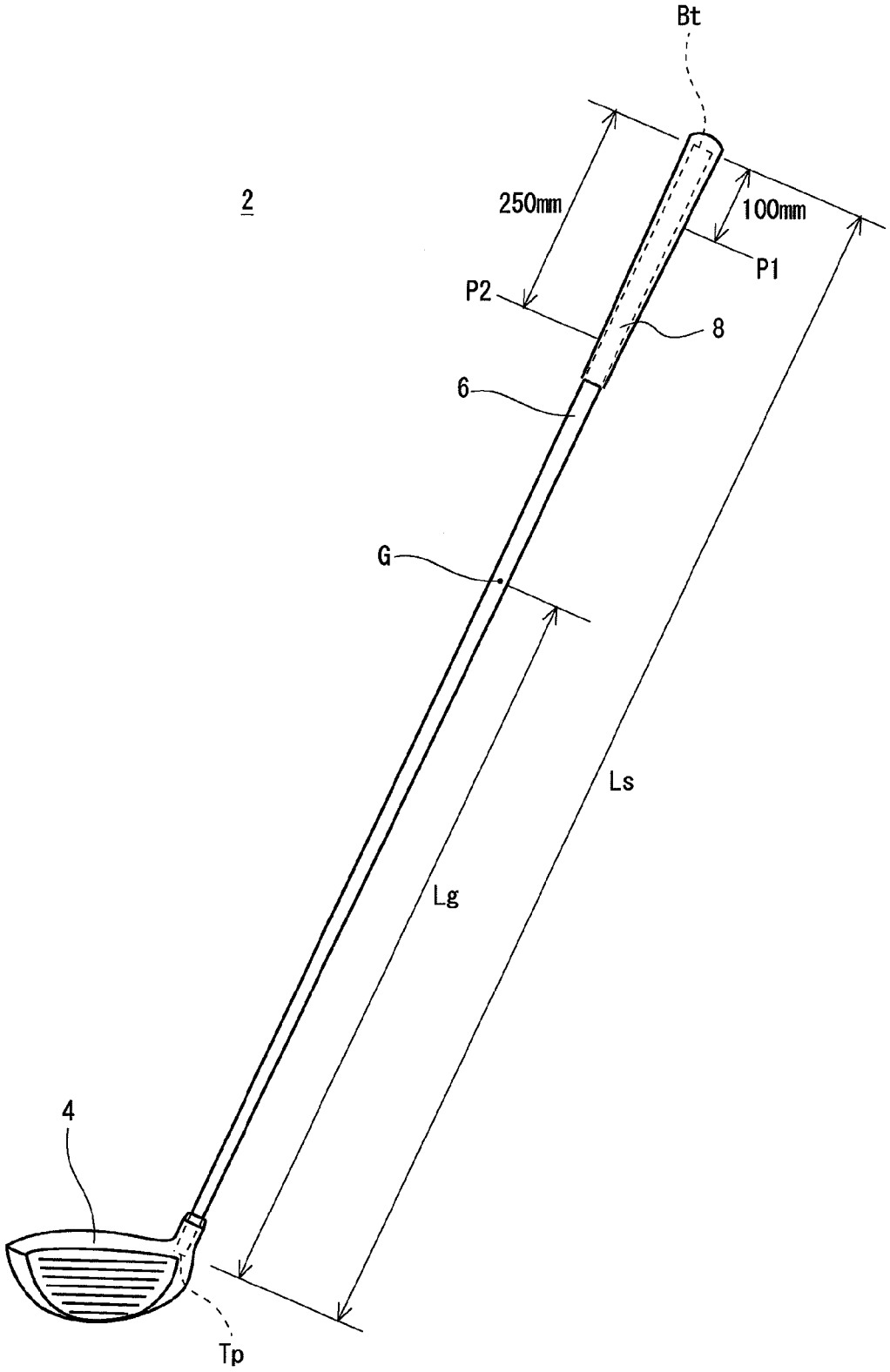
FIG. 1 shows a golf club including a shaft according to an embodiment of the present invention.

Hereinafter, the present invention will be described in detail based on the preferred embodiments with appropriate references to the accompanying drawings.

The term "layer" and the term "sheet" are used in the present application. The "layer" is termed after being wound. On the other hand, the "sheet" is termed before being wound. The "layer" is formed by winding the "sheet". That is, the wound "sheet" forms the "layer". In the present application, the same reference numeral is used in the layer and the sheet. For example, a layer formed by a sheet a1 is defined as a layer a1.

In the present application, an "inside" means an inside in a radial direction of a shaft. In the present application, an "outside" means an outside in the radial direction of the shaft.

In the present application, an "axis direction" means an axis direction of the shaft.

In the present application, an angle Af and an absolute angle θa are used for the angle of a fiber to the axis direction. The angle Af is a plus or minus angle. The absolute angle θa is the absolute value of the angle Af. In other words, the absolute angle θa is the absolute value of an angle between the axis direction and the direction of the fiber. For example, "the absolute angle θa is equal to or less than 10 degrees" means that "the angle Af is −10 degrees or greater and +10 degrees or less".

[First Embodiment]

FIG. 1 shows a golf club 2 provided with a golf club shaft 6 according to a first embodiment of the present invention. The golf club 2 is provided with a head 4, a shaft 6, and a grip 8. The head 4 is provided at the tip part of the shaft 6. The grip 8 is provided at the back end part of the shaft 6. The head 4 and the grip 8 are not restricted. Examples of the head 4 include a wood type golf club head, a hybrid type golf club head, a utility type golf club head, an iron type golf club head, and a putter head.

The head 4 of the embodiment is a wood type golf club head. A comparatively long club has a high effect of improving a flight distance. In this respect, the wood type golf club head, the hybrid type golf club head, and the utility type golf club head are preferable as the head 4. A hollow head has a large moment of inertia. A club with a head having a large moment of inertia stably has an effect of improving a flight distance. In this respect, the head 4 is preferably hollow.

The material of the head 4 is not restricted. Examples of the material of the head 4 include titanium, a titanium alloy, CFRP (carbon fiber reinforced plastic), stainless steel, maraging steel, and soft iron. A plurality of materials can be combined. For example, the CFRP and the titanium alloy can be combined. In respect of lowering the center of gravity of the head, at least a part of a crown may be made of CFRP and at least a part of a sole may be made of a titanium alloy. In respect of a strength, the whole face is preferably made of a titanium alloy.

The shaft 6 includes a laminate of fiber reinforced resin layers. The shaft 6 is a tubular body. The shaft 6 has a hollow structure. As shown in FIG. 1, the shaft 6 has a tip end Tp and a butt end Bt. The tip end Tp is located in the head 4. The butt end Bt is located in the grip 8.

The shaft 6 is a so-called carbon shaft. The shaft 6 is preferably produced by curing a prepreg sheet. In the prepreg sheet, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, fibers contained in the prepreg sheet may be woven.

The prepreg sheet has a fiber and a resin. The resin is also referred to as a matrix resin. The fiber is typically a carbon fiber. The matrix resin is typically a thermosetting resin.

The shaft 6 is manufactured by a so-called sheet winding method. In the prepreg, the matrix resin is in a semicured state. The shaft 6 is obtained by winding and curing the prepreg sheet. The curing means the curing of the semicured matrix resin. The curing is attained by heating. The manufacturing process of the shaft 6 includes a heating process. The heating process cures the matrix resin of the prepreg sheet.

Figure 2:
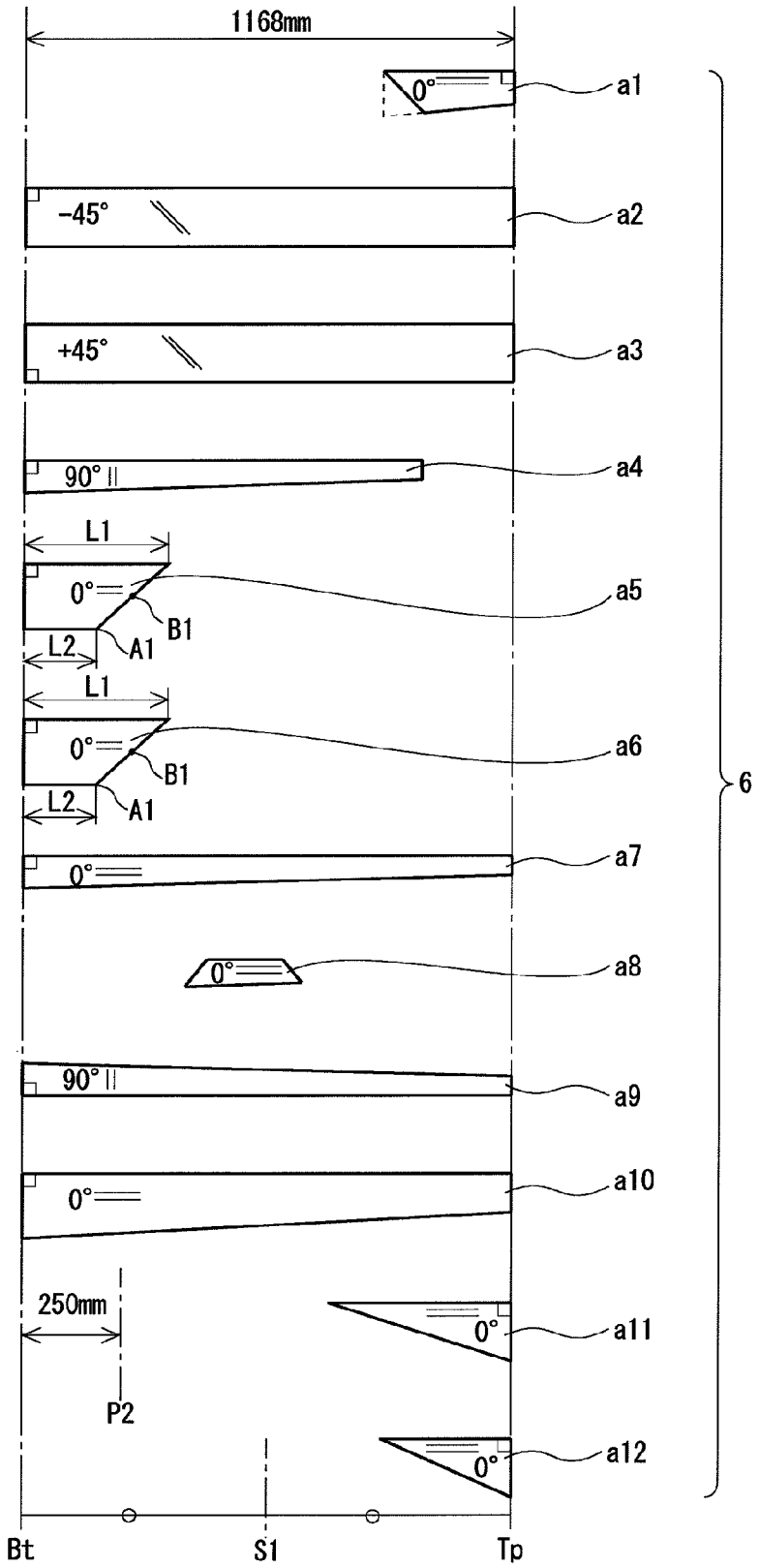
FIG. 2 is a developed view of a shaft according to a first embodiment.

FIG. 2 is a developed view (sheet constitution view) of the prepreg sheets constituting the shaft 6. The shaft 6 includes a plurality of sheets. In the embodiment of FIG. 2, the shaft 6 includes twelve sheets a1 to a12. In the present application, the developed view shown in FIG. 2 or the like shows the sheets constituting the shaft in order from the radial inside of the shaft. The sheets are wound in order from the sheet located above in the developed view. In the developed view of the present application, the horizontal direction of the figure coincides with the axis direction of the shaft. In the developed view of the present application, the right side of the figure is the tip end Tp side of the shaft. In the developed view of the present application, the left side of the figure is the butt end Bt side of the shaft.

The developed view of the present application shows not only the winding order of each of the sheets but also the disposal of each of the sheets in the axis direction of the shaft. For example, in FIG. 2, the end of the sheet a1 is located at the tip end Tp. For example, in FIG. 2, the ends of the sheet a5 and the sheet a6 are located at the butt end Bt.

The shaft 6 has a straight layer, a bias layer, and a hoop layer. The orientation angle of the fiber is described in the developed view of the present application. A sheet described as "0 degree" constitutes the straight layer. The sheet for the straight layer is also referred to as a straight sheet in the present application.

The straight layer is a layer in which the orientation direction of the fiber is substantially 0 degree to the longitudinal direction (axis direction of the shaft) of the shaft. The orientation of the fiber may not be completely set to 0 degree to the axis direction of the shaft by error or the like in winding. Usually, in the straight layer, the absolute angle θa is equal to or less than 10 degrees.

In the embodiment of FIG. 2, the straight sheets are the sheet a1, the sheet a5, the sheet a6, the sheet a7, the sheet a8, the sheet a10, the sheet all, and the sheet a12. The straight layer is highly correlated with the flexural rigidity and flexural strength of the shaft.

On the other hand, the bias layer is highly correlated with the torsional rigidity and torsional strength of the shaft. Preferably, the bias layer includes two sheets in which orientation angles of fibers are inclined in opposite directions to each other. In respect of the torsional rigidity, the absolute angle θa of the bias layer is preferably equal to or greater than 15 degrees, more preferably equal to or greater than 25 degrees, and still more preferably equal to or greater than 40 degrees. In respects of the torsional rigidity and the flexural rigidity, the absolute angle θa of the bias layer is preferably equal to or less than 60 degrees, and more preferably equal to or less than 50 degrees.

In the shaft 6, the sheets constituting the bias layer are the sheet a2 and the sheet a3. In FIG. 2, the angle Af is described in each sheet. The plus (+) and minus (−) in the angle Af show that the fibers of bias sheets are inclined in opposite directions to each other. In the present application, the sheet for the bias layer is also merely referred to as the bias sheet.

In the embodiment of FIG. 2, the angle of the sheet a2 is −45 degrees and the angle of the sheet a3 is +45 degrees. However, conversely, it should be appreciated that the angle of the sheet a2 may be +45 degrees and the angle of the sheet a3 may be −45 degrees.

In the shaft 6, the sheets constituting the hoop layer are the sheet a4 and the sheet a9. Preferably, the absolute angle θa in the hoop layer is substantially 90 degrees to a shaft axis line. However, the orientation direction of the fiber to the axis direction of the shaft may not be completely set to 90 degrees by error or the like in winding. Usually, in the hoop layer, the absolute angle θa is 80 degrees or greater and 90 degrees or less. In the present application, the prepreg sheet for the hoop layer is also referred to as a hoop sheet.

The hoop layer contributes to enhancement of the crushing rigidity and crushing strength of the shaft. The crushing rigidity is rigidity to a force crushing the shaft toward the inside of the radial direction thereof. The crushing strength is strength to a force crushing the shaft toward the inside of the radial direction thereof. The crushing strength can be also involved with the flexural strength. Crushing deformation can be generated with flexural deformation. In a particularly thin lightweight shaft, this interlocking property is large. The enhancement of the crushing strength also can cause the enhancement of the flexural strength.

Although not shown in the drawings, the prepreg sheet before being used is sandwiched between cover sheets. The cover sheets are usually a mold release paper and a resin film. That is, the prepreg sheet before being used is sandwiched between the mold release paper and the resin film. The mold release paper is applied to one surface of the prepreg sheet, and the resin film is applied to the other surface of the prepreg sheet. Hereinafter, the surface to which the mold release paper is applied is also referred to as "a surface of a mold release paper side", and the surface to which the resin film is applied is also referred to as "a surface of a film side".

In the developed view of the present application, the surface of the film side is the front side. That is, in the developed view of the present application, the front side of the figure is the surface of the film side, and the back side of the figure is the surface of the mold release paper side. For example, in FIG. 2, the direction of the fiber of the sheet a2 is the same as that of the sheet a3. However, in the case of the stacking to be described later, the sheet a3 is reversed. As a result, the directions of the fibers of the sheets a2 and a3 are opposite to each other. Therefore, in the state after being wound, the directions of the fibers of the sheets a2 and a3 are opposite to each other. In light of this point, in FIG. 2, the direction of the fiber of the sheet a2 is described as "−45 degrees", and the direction of the fiber of the sheet a3 is described as "+45 degrees".

In order to wind the prepreg sheet, the resin film is previously peeled. The surface of the film side is exposed by peeling the resin film. The exposed surface has tacking property (tackiness). The tacking property is caused by the matrix resin. That is, since the matrix resin is in a semicured state, the tackiness is developed. Next, the edge part of the exposed surface of the film side (also referred to as a winding start edge part) is applied to a wound object. The winding start edge part can be smoothly applied by the tackiness of the matrix resin. The wound object is a mandrel or a wound article obtained by winding the other prepreg sheet around the mandrel. Next, the mold release paper is peeled. Next, the wound object is rotated to wind the prepreg sheet around the wound object. Thus, the resin film is previously peeled, then, the winding start edge part is applied to the wound object, and then, the mold release paper is then peeled. That is, the resin film is previously peeled, after the winding start edge part is applied to the wound object, the mold release paper is peeled. The procedure suppresses wrinkles and winding fault of the sheet. This is because the sheet to which the mold release paper is applied is supported by the mold release paper, and hardly causes wrinkles. The mold release paper has flexural rigidity higher than that of the resin film.

A united sheet is used in the embodiment of FIG. 2. The united sheet is formed by stacking two or more sheets.

Figure 3:
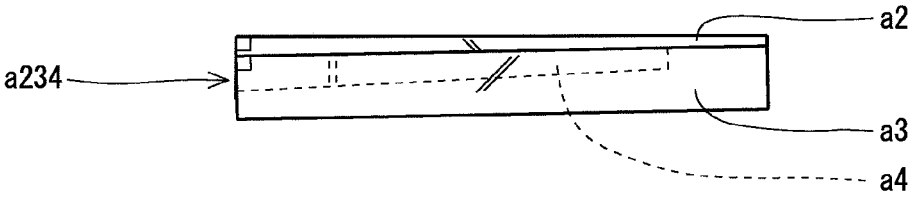
FIG. 3 is a plan view showing a first united sheet according to the shaft of FIG. 2.
Figure 4:
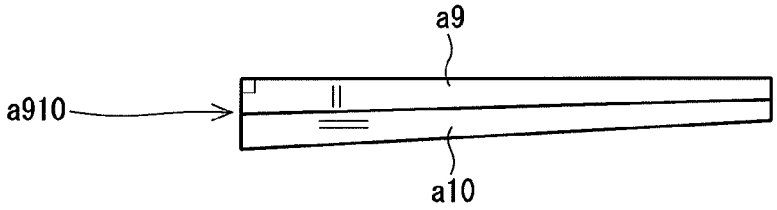
FIG. 4 is a plan view showing a second united sheet according to the shaft of FIG. 2.

The two united sheets are formed in the embodiment of FIG. 2. FIG. 3 shows a first united sheet a234. The united sheet a234 is formed by stacking the sheet a2, the sheet a3, and the sheet a4. FIG. 4 shows a second united sheet a910. The united sheet a910 is formed by stacking the sheet a9 and the sheet a10.

A procedure for producing the first united sheet a234 is as follows. First, a preliminary united sheet a34 obtained by stacking two sheets is produced. The sheet a3 and the sheet a4 are stacked. The second bias sheet a3 is stacked on the hoop sheet a4 while the second bias sheet a3 is reversed in the production of the preliminary united sheet a34. In the preliminary united sheet a34, the upper end of the sheet a4 coincides with the upper end of the sheet a3. Next, the preliminary united sheet a34 and the first bias sheet a2 are stacked. The preliminary united sheet a34 and the sheet a2 are stacked in a state where the preliminary united sheet a34 and the sheet a2 are deviated from each other for a half circle.

The sheet a2 and the sheet a3 are deviated for a half circle in the united sheet a234. That is, in the shaft after being wound, the circumferential position of the sheet a2 and the circumferential position of the sheet a3 are different from each other in the circumferential position. The difference angle is preferably 180 degrees (±15 degrees).

As a result of using the united sheet a234, a first bias layer a2 and a second bias layer a3 are deviated from each other in the circumferential position. The positions of the ends of the bias layers are dispersed in the circumferential direction by the deviation. The dispersion improves the uniformity of the shaft in the circumferential position. In the united sheet a234, the whole hoop sheet a4 is sandwiched between the first bias sheet a2 and the second bias sheet a3 (see FIG. 3). Therefore, the winding fault of the hoop sheet a4 is suppressed in a winding process. The use of the united sheet a234 can improve winding accuracy. The winding fault means the disturbance of the fiber, the generation of wrinkles, and the deviation of the fiber angle or the like.

As shown in FIG. 4, in the second united sheet a910, the upper end of the sheet a9 coincides with the upper end of the sheet a10. In the sheet a910, the whole sheet a9 is stacked on the sheet a10. Therefore, the winding fault of the sheet a9 is suppressed in the winding process.

As described above, in the present application, the sheet and the layer are classified by the orientation angle of the fiber. Furthermore, in the present application, the sheet and the layer are classified by the length of the axis direction of the shaft.

In the present application, a layer disposed all over in the axis direction of the shaft is referred to as a full length layer. In the present application, a sheet disposed all over in the axis direction of the shaft is referred to as a full length sheet. The wound full length sheet forms the full length layer.

On the other hand, in the present application, a layer partially disposed in the axis direction of the shaft is referred to as a partial layer. In the present application, a sheet partially disposed in the axis direction of the shaft is referred to as a partial sheet. The wound partial sheet forms the partial layer.

In the present application, the full length layer which is the straight layer is referred to a full length straight layer. In the embodiment of FIG. 2, the full length straight layers are the sheet a7 and the sheet a10.

In the present application, the full length layer which is the hoop layer is referred to as a full length hoop layer. In the embodiment of FIG. 2, the full length hoop layer is the sheet a9.

In the present application, the partial layer which is the straight layer is referred to a partial straight layer. In the embodiment of FIG. 2, the partial straight layers are the sheet a1, the sheet a5, the sheet a6, the sheet a8, the sheet all, and the sheet alt.

In the present application, the partial layer which is the hoop layer is referred to as a partial hoop layer. In the embodiment of FIG. 2, the partial hoop layer is the sheet a4.

The sheet a8 is an intermediate partial layer. The tip of the intermediate partial layer is separated from the tip end Tp. The back end of the intermediate partial layer is separated from the butt end Bt. Preferably, the intermediate partial layer is disposed at a position including a center position S1 in the axis direction of the shaft. Preferably, the intermediate partial layer is disposed at a position including a point B. The point B is defined in a method for measuring a three-point flexural strength, which will be described later. The axial center part of the shaft is largely deformed by flexure. The intermediate partial layer can selectively reinforce a largely deformed portion. The intermediate partial layer can contribute to the weight saving of the shaft.

The term "butt partial layer" is used in the present application. The butt partial layer is one aspect of the partial layer. A point located nearest to the butt side on the tip side edge of the butt partial layer is represented by reference numeral A1 in FIG. 2. Preferably, the point A1 is located on the butt side of the center position S1 in the axis direction of the shaft. A middle point of the tip side edge of the butt partial layer is represented by reference numeral B1 in FIG. 2. More preferably, the middle point B1 is located on the butt side of the center position S1 in the axis direction of the shaft. Examples of the butt partial layer include a butt straight layer, a butt hoop layer, and a butt bias layer.

In the present application, the term "butt straight layer" is used. The butt straight layer is a partial straight layer. Preferably, the whole butt straight layer is located in the butt part from the center position in the axis direction of the shaft. The back end of the butt straight layer may not be located in the butt end Bt of the shaft, and may be located in the butt end Bt of the shaft. In respect of bringing the position of the center of gravity of the shaft near to the butt end Bt, the disposal range of the butt straight layer preferably includes a position P1 separated by 100 mm from the butt end Bt of the shaft. In respect of bringing the center of gravity of the shaft near to the butt end Bt, the back end of the butt straight layer is more preferably located in the butt end Bt of the shaft.

In the embodiment of FIG. 2, the butt straight layers are the sheet a5 and the sheet a6.

In the embodiment of FIG. 2, the term "butt hoop layer" is used in the present application. The butt hoop layer is the partial hoop layer. The back end of the butt hoop layer may not be located in the butt end Bt of the shaft, and may be located in the butt end Bt of the shaft. In respect of reinforcing the back end portion of the shaft, preferably, the disposal range of the butt hoop layer includes the position P1 separated by 100 mm from the butt end Bt of the shaft. More preferably, the back end of the butt hoop layer is located in the butt end Bt of the shaft.

The shaft 6 is produced by the sheet winding method using the sheets shown in FIG. 2.

Hereinafter, a manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process

A plurality of sheets is stacked in the stacking process, to produce the above-mentioned united sheets a234 and a910.

In the stacking process, heating or a press may be used. More preferably, the heating and the press are used in combination. In a winding process to be described later, the deviation of the sheet may be produced during the winding operation of the united sheet. The deviation reduces winding accuracy. The heating and the press improve an adhesive force between the sheets. The heating and the press suppress the deviation between the sheets in the winding process.

In respect of enhancing the adhesive force between the sheets, a heating temperature in the stacking process is preferably equal to or greater than 30° C., and more preferably equal to or greater than 35° C. When the heating temperature is too high, the curing of the matrix resin may be progressed, to reduce the tackiness of the sheet. The reduction of the tackiness reduces adhesion between the united sheet and the wound object. The reduction of the adhesion may allow the generation of wrinkles, to generate the deviation of a winding position. In this respect, the heating temperature in the stacking process is preferably equal to or less than 60° C., more preferably equal to or less than 50° C., and still more preferably equal to or less than 40° C.

In respect of enhancing the adhesive force between the sheets, a heating time in the stacking process is preferably equal to or greater than 20 seconds, and more preferably equal to or greater than 30 seconds. In respect of maintaining the tackiness of the sheet, the heating time in the stacking process is preferably equal to or less than 300 seconds.

In respect of enhancing the adhesive force between the sheets, a press pressure in the stacking process is preferably equal to or greater than 300 g/cm$^2$, and more preferably equal to or greater than 350 g/cm$^2$. When the press pressure is excessive, the prepreg may be crushed. In this case, the thickness of the prepreg is made thinner than a designed value. In respect of thickness accuracy of the prepreg, the press pressure in the stacking process is preferably equal to or less than 600 g/cm$^2$, and more preferably equal to or less than 500 g/cm$^2$.

In respect of enhancing the adhesive force between the sheets, a press time in the stacking process is preferably equal to or greater than 20 seconds, and more preferably equal to or greater than 30 seconds. In respect of the thickness accuracy of the prepreg, the press time in the stacking process is preferably equal to or less than 300 seconds.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

The stacked sheets are wound in a state of the united sheet.

A winding body is obtained by the winding process. The winding body is obtained by wrapping the prepreg sheet around the outside of the mandrel. For example, the winding is performed by rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The wrapping tape is wrapped while tension is applied to the wrapping tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The order of the both processes is not restricted. However, the process of removing the wrapping tape is preferably performed after the process of extracting the mandrel in respect of improving the efficiency of the process of removing the wrapping tape.

(7) Process of Cutting Both Ends

The both end parts of the cured laminate are cut in the process. The cutting flattens the end face of the tip end Tp and the end face of the butt end Bt.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to flatten the surface of the cured laminate.

(9) Coating Process

The cured laminate after the polishing process is subjected to coating.

The shaft 6 is obtained in the processes. In the shaft 6, a ratio (Lg/Ls) is large. The shaft 6 is lightweight, and has a large ratio (Lg/Ls).

In the present application, "a ratio of a center of gravity of a shaft" is used. The ratio of the center of gravity of the shaft (%) is [(Lg/Ls)×100].

The head 4 and the grip 8 are attached to the shaft 6 thus manufactured, to obtain the golf club 2.

[Second Embodiment]

Figure 5:
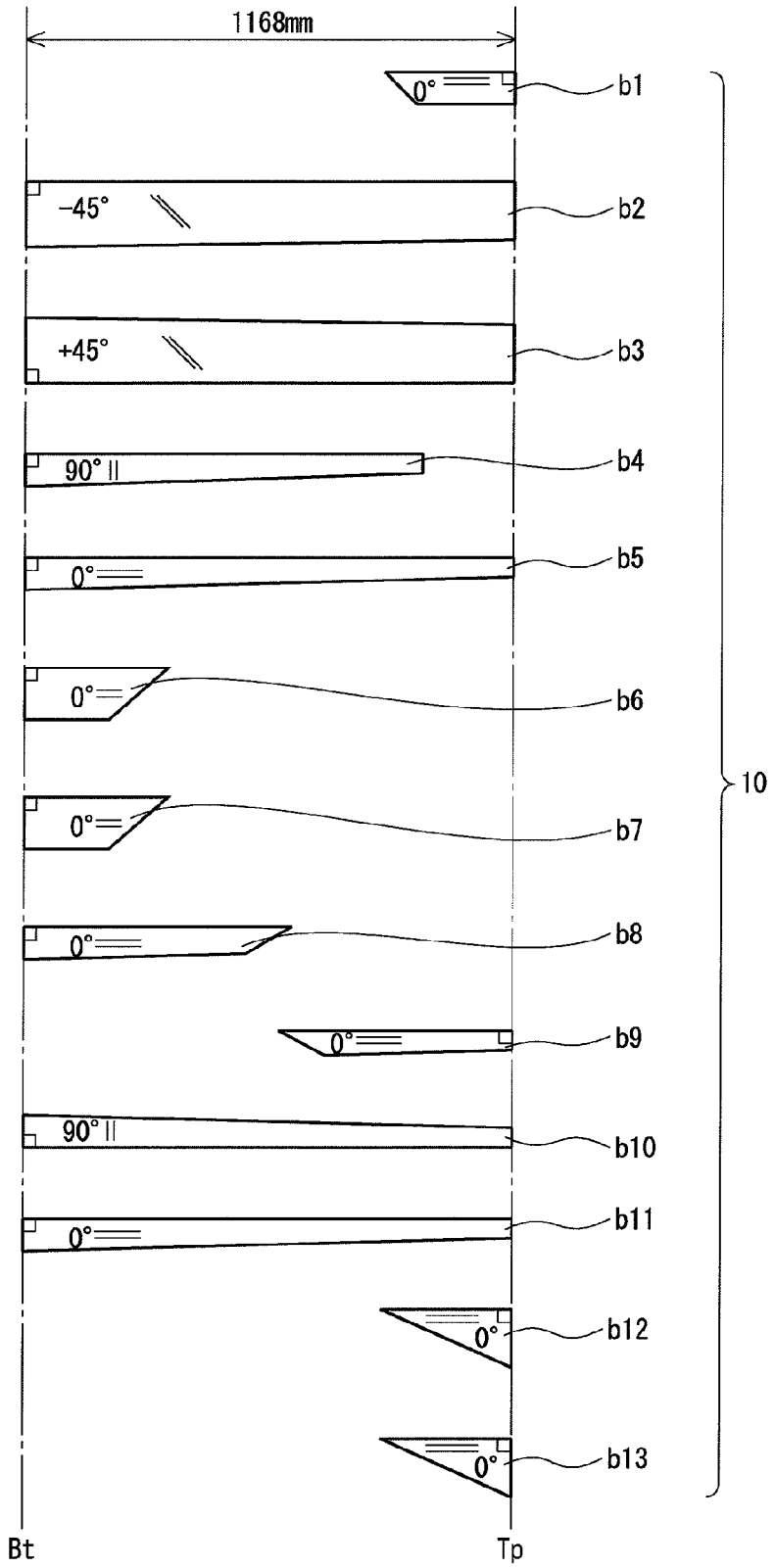
FIG. 5 is a developed view of a shaft according to a second embodiment.

FIG. 5 is a developed view of prepreg sheets constituting a shaft 10 according to a second embodiment. The shaft 10 includes a plurality of sheets. In the embodiment, the shaft 10 includes thirteen sheets b1 to b13.

The shaft 10 has a straight layer, a bias layer, and a hoop layer. In the embodiment of FIG. 5, straight sheets are a sheet b1, a sheet b5, a sheet b6, a sheet b7, a sheet b8, a sheet b9, a sheet b11, a sheet b12, and a sheet b13. In the shaft 10, sheets constituting the bias layer are a sheet b2 and a sheet b3. In the shaft 10, sheets constituting the hoop layer are a sheet b4 and a sheet b10.

In the embodiment of FIG. 5, a united sheet is used. Two united sheets are formed in the embodiment of FIG. 5. Although not shown in the drawings, a first united sheet b234 is formed by stacking the sheet b2, the sheet b3, and the sheet b4. The manufacturing method and the constitution of the united sheet b234 are the same as those of the above-mentioned united sheet a234. Although not shown in the drawings, a second united sheet b1011 is formed by stacking the sheet b10 and the sheet b11.

In the embodiment of FIG. 5, butt straight layers are the sheet b6 and the sheet b7. In the embodiment of FIG. 5, a butt hoop layer is the sheet b4.

The manufacturing method of the shaft 10 is the same as that of the shaft 6. Also in the shaft 10, the ratio of the center of gravity of the shaft is large. The shaft 10 is lightweight, and can provide a large ratio of a center of gravity of the shaft.

[Center of Gravity G of Shaft]

The center of gravity of the shaft 6 is represented by reference numeral G in FIG. 1. The center of gravity G is located in the shaft. The center of gravity G is located on the shaft axis line.

[Shaft Full Length Ls]

A shaft full length is represented by a double pointed arrow Ls in FIG. 1. The present invention is effective in a comparatively long golf club. In this respect, the shaft full length Ls is preferably equal to or greater than 42 inch, more preferably equal to or greater than 43 inch, still more preferably equal to or greater than 44 inch, yet still more preferably equal to or greater than 44.5 inch, and particularly preferably equal to or greater than 45 inch. In respects of easiness to swing and the golf rules, the shaft full length Ls is preferably equal to or less than 47 inch.

[Distance Lg Between Tip End Tp and Center of Gravity G of Shaft]

An axial distance between the tip end Tp and the center of gravity G of the shaft is represented by a double pointed arrow Lg in FIG. 1. When the distance Lg is long, the center of gravity G of the shaft is close to the butt end Bt. The position of the center of gravity can cause a light swing balance and improve the easiness to swing. The position of the center of gravity can contribute to improvement in a head speed.

In respects of the easiness to swing and the head speed, the distance Lg is preferably equal to or greater than 615 mm, more preferably equal to or greater than 620 mm, still more preferably equal to or greater than 625 mm, and yet still more preferably equal to or greater than 630 mm.

When the center of gravity G of the shaft is too close to the butt end Bt, a centrifugal force acting on the center of gravity G of the shaft is apt to be reduced. That is, when the ratio of the center of gravity of the shaft is large, the centrifugal force acting on the center of gravity G of the shaft is apt to be reduced. In this case, the flexure of the shaft may be hardly felt. The shaft of which the flexure is hardly felt is apt to cause a rigid feeling. In respect of suppressing the rigid feeling, the distance Lg is preferably equal to or less than 660 mm, more preferably equal to or less than 655 mm, and still more preferably equal to or less than 650 mm.

A golf player feels difficulty to swing caused by the rigid feeling. In respect of the easiness to swing, the rigid feeling is preferably suppressed.

[Lg/Ls] (Ratio of Center of Gravity of Shaft)

In respects of the easiness to swing and the head speed, the ratio (Lg/Ls) is preferably equal to or greater than 0.52, more preferably equal to or greater than 0.53, and still more preferably equal to or greater than 0.54. When the ratio (Lg/Ls) is excessively large, the shaft strength of the tip part may be reduced. In respect of the shaft strength, the ratio (Lg/Ls) is preferably equal to or less than 0.65, and more preferably equal to or less than 0.64.

Examples of means for adjusting the ratio of the center of gravity of the shaft include the following items (a1) to (a8):

(a1) increase or decrease of number of windings of the butt partial layer;

(a2) increase or decrease of a thickness of the butt partial layer;

(a3) increase or decrease of a length L1 (to be described later) of the butt partial layer;

(a4) increase or decrease of a length L2 (to be described later) of the butt partial layer;

(a5) increase or decrease of number of windings of a tip partial layer;

(a6) increase or decrease of a thickness of the tip partial layer;

(a7) increase or decrease of an axial length of the tip partial layer; and (a8) increase or decrease of a taper ratio of the shaft.

[Shaft Weight Ws]

When the shaft weight Ws is small as described above, the center of gravity G of the shaft tends to be close to the tip end Tp. The synergic effect of the light shaft weight Ws and the large ratio of the center of gravity of the shaft can further improve the head speed. In this respect, the shaft weight Ws is preferably equal to or less than 60 g, more preferably equal to or less than 52 g, more preferably equal to or less than 51 g, more preferably equal to or less than 50 g, more preferably less than 50 g, more preferably equal to or less than 49 g, and still more preferably equal to or less than 48 g. In respect of the shaft strength, the shaft weight Ws is preferably equal to or greater than 30 g, more preferably equal to or greater than 36 g, more preferably equal to or greater than 38 g, and still more preferably equal to or greater than 40 g.

[Weight Ratio of Butt Partial Layer with Respect to the Shaft Weight Ws]

In respect of increasing the ratio of the center of gravity of the shaft, the weight of the butt partial layer is preferably equal to or greater than 5% by weight based on the shaft weight Ws, and more preferably equal to or greater than 10% by weight. In respect of suppressing the rigid feeling, the weight of the butt partial layer is preferably equal to or less than 50% by weight based on the shaft weight Ws, and more preferably equal to or less than 45% by weight. In the embodiment of FIG. 2, the total weight of the sheet a5 and the sheet a6 is the weight of the butt partial layer.

[Weight Ratio of Butt Partial Layer in Specific Butt Range]

A point separated by 250 mm from the butt end Bt is represented by P2 in FIG. 1. A range from the point P2 to the butt end Bt is defined as a specific butt range. A weight of the butt partial layer existing in the specific butt range is defined as Wa, and a weight of the shaft in the specific butt range is defined as Wb. In respect of increasing the ratio of the center of gravity of the shaft, a ratio (Wa/Wb) is preferably equal to or greater than 0.4, more preferably equal to or greater than 0.42, more preferably equal to or greater than 0.43, and still more preferably equal to or greater than 0.44. In respect of suppressing the rigid feeling, the ratio (Wa/Wb) is preferably equal to or less than 0.7, more preferably equal to or less than 0.65, and still more preferably equal to or less than 0.6.

[Fiber Elastic Modulus of Butt Partial Layer]

In respect of the strength of the butt part, the fiber elastic modulus of the butt partial layer is preferably equal to or greater than 5 t/mm$^2$, and more preferably equal to or greater than 7 t/mm$^2$.

When the center of gravity G of the shaft is close to the butt end Bt, the centrifugal force acting on the center of gravity G of the shaft is apt to be reduced. That is, when the ratio of the center of gravity of the shaft is large, the centrifugal force acting on the center of gravity G of the shaft is apt to be reduced. In this case, the flexure of the shaft may be hardly felt. Therefore, the rigid feeling is apt to be caused. In respect of suppressing the rigid feeling, the fiber elastic modulus of the butt partial layer is preferably equal to or less than 20 t/mm$^2$, more preferably equal to or less than 15 t/mm$^2$, and still more preferably equal to or less than 10 t/mm$^2$.

[Resin Content of Butt Partial Layer]

In respects of increasing the ratio of the center of gravity of the shaft and of suppressing the rigid feeling, the resin content of the butt partial layer is preferably equal to or greater than 20% by weight, and more preferably equal to or greater than 25% by weight. In respect of the strength of the butt part, the resin content of the butt partial layer is preferably equal to or less than 50% by weight, and more preferably equal to or less than 45% by weight.

[Weight of Butt Straight Layer]

In respect of increasing the ratio of the center of gravity of the shaft, the weight of the butt straight layer is preferably equal to or greater than 2 g, more preferably equal to or greater than 4 g, and still more preferably equal to or greater than 8 g. In respect of suppressing the rigid feeling, the weight of the butt straight layer is preferably equal to or less than 30 g, more preferably equal to or less than 20 g, and still more preferably equal to or less than 10 g.

[Weight Ratio of Butt Straight Layer with Respect to the Shaft Weight Ws]

In respect of increasing the ratio of the center of gravity of the shaft, the weight of the butt straight layer is preferably equal to or greater than 5% by weight based on the shaft weight Ws, and more preferably equal to or greater than 10% by weight. In respect of suppressing the rigid feeling, the weight of the butt straight layer is preferably equal to or less than 50% by weight based on the shaft weight Ws, and more preferably equal to or less than 45% by weight. In the embodiment of FIG. 2, the total weight of the sheet a5 and the sheet a6 is the weight of the butt straight layer.

[Fiber Elastic Modulus of Butt Straight Layer]

In respect of the strength of the butt part, the fiber elastic modulus of the butt straight layer is preferably equal to or greater than 5 t/mm$^2$, and more preferably equal to or greater than 7 t/mm$^2$.

When the center of gravity G of the shaft is close to the butt end Bt, the centrifugal force acting on the center of gravity G of the shaft is apt to be reduced. That is, when the ratio of the center of gravity of the shaft is large, the centrifugal force acting on the center of gravity G of the shaft is apt to be reduced. In this case, the flexure of the shaft may be hardly felt. Therefore, the rigid feeling is apt to be caused. In respect of suppressing the rigid feeling, the fiber elastic modulus of the butt straight layer is more preferably equal to or less than 20 t/mm$^2$, more preferably equal to or less than 15 t/mm$^2$, and still more preferably equal to or less than 10 t/mm$^2$.

[Resin Content of Butt Straight Layer]

In respects of increasing the ratio of the center of gravity of the shaft and of suppressing the rigid feeling, the resin content of the butt straight layer is preferably equal to or greater than 20% by weight, and more preferably equal to or greater than 25% by weight. In respect of the strength of the butt part, the resin content of the butt straight layer is preferably equal to or less than 50% by weight, and more preferably equal to or less than 45% by weight.

[Axial Maximum Length L1 of Butt Partial Layer]

An axial maximum length of the butt partial layer is represented by a double pointed arrow L1 in FIG. 2. The length L1 is specified in each of butt partial sheets. In the embodiment of FIG. 2, the length L1 of the sheet a5 is the same as the length L1 of the sheet a6.

In respect of securing the weight of the butt partial layer, the length L1 is preferably equal to or greater than 100 mm, more preferably equal to or greater than 125 mm, and still more preferably equal to or greater than 150 mm. In respect of increasing the ratio of the center of gravity of the shaft, the length L1 is preferably equal to or less than 700 mm, more preferably equal to or less than 650 mm, and still more preferably equal to or less than 600 mm.

[Axial Minimum Length L2 of Butt Partial Layer]

An axial minimum length of the butt partial layer is represented by a double pointed arrow L2 in FIG. 2. The length L2 is specified in each of the butt partial sheets. In the embodiment of FIG. 2, the length L2 of the sheet a5 is the same as the length L2 of the sheet a6.

In respect of securing the weight of the butt partial layer, the length L2 is preferably equal to or greater than 50 mm, more preferably equal to or greater than 75 mm, and still more preferably equal to or greater than 100 mm. In respect of increasing the ratio of the center of gravity of the shaft, the length L2 is preferably equal to or less than 650 mm, more preferably equal to or less than 600 mm, and still more preferably equal to or less than 550 mm.

[Bias Sheet]

When the butt partial layer is disposed, the rigidity of the vicinity of the grip is increased. The increased rigidity applies the rigid feeling of the shaft to the golf player. Particularly, the rigid feeling is not preferable for an average golf player. Many golf players hardly swing the club applying the rigid feeling. In respect of suppressing the rigid feeling, the torsional rigidity of the butt part is preferably suppressed. In this respect, the number of windings (PLY number) of the full length bias layer is preferably reduced gradually or in steps toward the butt end Bt. In the embodiment of FIG. 2, the sheet a2 and the sheet a3 are rectangles. Therefore, in the tapered shaft, the number of windings of the full length bias layer is reduced gradually or in steps toward the butt end Bt.

[Shaft Outer Diameter]

When the butt partial layer is used, a shaft outer diameter in the specific butt range is increased. When the shaft outer diameter is increased, a cross sectional secondary moment is increased, and the flexural rigidity of the shaft is apt to be excessive. In respect of suppressing the rigid feeling, the shaft outer diameter in the specific butt range is preferably equal to or less than 17 mm, more preferably equal to or less than 16.5 mm, and still more preferably equal to or less than 16 mm. In respect of securing moderate rigidity in the butt part, the shaft outer diameter in the specific butt range is preferably equal to or greater than 11 mm, more preferably equal to or greater than 12 mm, and still more preferably equal to or greater than 13 mm.

[Shaft Thickness]

When the butt partial layer is used, a shaft thickness in the specific butt range is increased. When the shaft thickness is increased, a cross sectional secondary moment is increased, and the flexural rigidity of the shaft is apt to be excessive. In respect of suppressing the rigid feeling, the shaft thickness in the specific butt range is preferably equal to or less than 1.3 mm, more preferably equal to or less than 1.2 mm, and still more preferably equal to or less than 1.1 mm. In respect of securing moderate rigidity in the butt part, the shaft thickness in the specific butt range is preferably equal to or greater than 0.4 mm, more preferably equal to or greater than 0.5 mm, and still more preferably equal to or greater than 0.6 mm. The shaft thickness can be calculated by dividing the difference between an outer diameter and an inner diameter by 2.

[Forward Flex F1]

In the case of the excessively flexed shaft, hit balls may vary. In this respect, a forward flex F1 is preferably equal to or less than 155 mm, and more preferably equal to or less than 150 mm. When the conformity of the shaft to the average golf player is considered, the forward flex F1 is preferably equal to or greater than 125 mm, and more preferably equal to or greater than 130 mm.

Figure 6A:
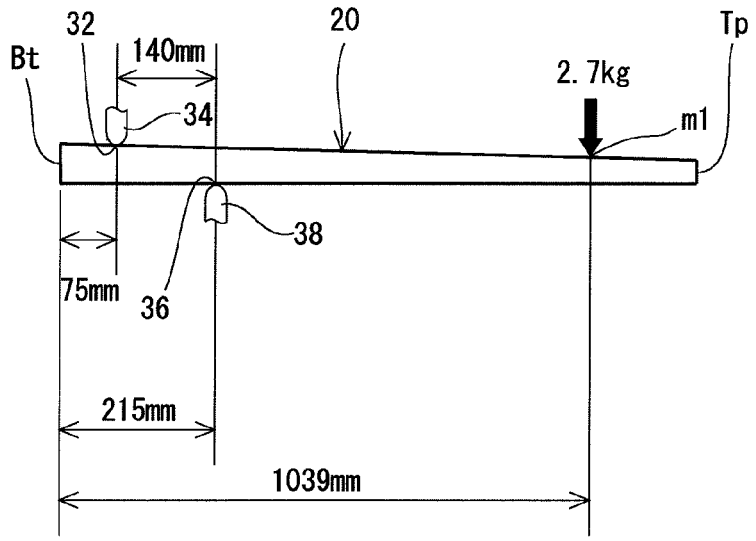
FIG. 6A shows a method for measuring a forward flex.

FIG. 6A shows a method for measuring the forward flex F1. As shown in FIG. 6A, a first supporting point 32 is set at a position which is 75 mm away from the butt end Bt. Furthermore, a second supporting point 36 is set at a position which is 215 mm away from the butt end Bt. A support 34 supporting the shaft 20 from the upside is provided at the first supporting point 32. A support 38 supporting the shaft 20 from the underside is provided at the second supporting point 36. In a state where no load is applied, the shaft axis line of the shaft 20 is substantially horizontal. At a load point m1 which is 1039 mm away from the butt end Bt, a load of 2.7 kg is allowed to act in a vertical downward direction. A travel distance (mm) of the load point m1 between the state where no load is applied and a state where a load is applied is determined as the forward flex F1. The travel distance is a travel distance along the vertical direction.

The section shape of a portion (hereinafter, referred to as an abutting portion) of the support 34 abutting on the shaft is as follows. The section shape of the abutting portion of the support 34 has convex roundness in a section parallel to the axis direction of the shaft. The curvature radius of the roundness is 15 mm. The section shape of the abutting portion of the support 34 has concave roundness in a section perpendicular to the axis direction of the shaft. The curvature radius of the concave roundness is 40 mm. The horizontal length (a length in a depth direction in FIG. 6) of the abutting portion of the support 34 is 15 mm in the section perpendicular to the axis direction of the shaft. The section shape of the abutting portion of the support 38 is the same as that of the support 34. The section shape of the abutting portion of a load indenter (not shown) applying a load of 2.7 kg at the load point m1 has convex roundness in the section parallel to the axis direction of the shaft. The curvature radius of the roundness is 10 mm. The section shape of the abutting portion of a load indenter (not shown) applying a load of 2.7 kg at the load point m1 is a straight line in the section perpendicular to the axis direction of the shaft. The length of the straight line is 18 mm.

[Backward Flex F2]

In the case of the excessively flexed shaft, hit balls may vary. In this respect, a backward flex F2 is preferably equal to or less than 145 mm, and more preferably equal to or less than 140 mm. When the conformity of the shaft to the average golf player is considered, the backward flex F2 is preferably equal to or greater than 118 mm, and more preferably equal to or greater than 120 mm.

[Backward Flex F2]

Figure 6B:
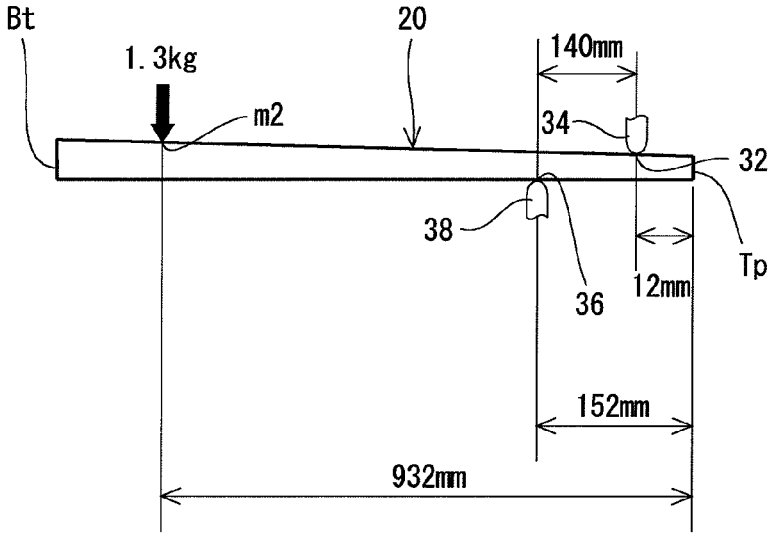
FIG. 6B shows a method for measuring a backward flex.

A measuring method of a backward flex is shown in FIG. 6B. The backward flex F2 is measured in the same manner as in the forward flex F1 except that the first supporting point 32 is set to a point separated by 12 mm from a tip end Tp; the second supporting point 36 is set to a point separated by 152 mm from the tip end Tp; a load point m2 is set to a point separated by 932 mm from the tip end Tp; and a load is set to 1.3 kg.

[Flex Point Ratio C1 of Shaft]

In the present application, a flex point ratio C1 of the shaft (%) is defined by the following formula.

$$C1=[F2/(F1+F2)]\times 100$$

F1 is the forward flex (mm), and F2 is the backward flex (mm).

When the center of gravity G of the shaft is close to the butt end Bt, a centrifugal force acting on the center of gravity G of the shaft is apt to be reduced. That is, when the ratio of the center of gravity of the shaft is large, the centrifugal force acting on the center of gravity G of the shaft is apt to be reduced. In this case, the flexure of the shaft may be hardly felt. The shaft of which the flexure is hardly felt is apt to cause a rigid feeling. A portion close to the grip tends to be flexed, and thereby the rigid feeling can be reduced. In this respect, the flex point ratio C1 of the shaft is preferably equal to or less than 50%, more preferably equal to or less than 49%, and still more preferably equal to or less than 48%. When the flex point ratio C1 of the shaft is excessively small, the flexure of a butt portion is excessive, which may reduce the strength. In this respect, the flex point ratio C1 of the shaft is preferably equal to or greater than 38%, and more preferably equal to or greater than 40%.

[Three-Point Flexural Strength]

A three-point flexural strength in the present application is based on an SG type three-point flexural strength test. This is a test set by Consumer Product Safety Association. A measuring method of the SG type three-point flexural strength test will be described later. Measured points are a point T, a point A, a point B, and a point C. The point T is a point separated by 90 mm from the tip end Tp. The point A is a point separated by 175 mm from the tip end Tp. The point B is a point separated by 525 mm from the tip end Tp. The point C is a point separated by 175 mm from the butt end Bt.

Figure 7:
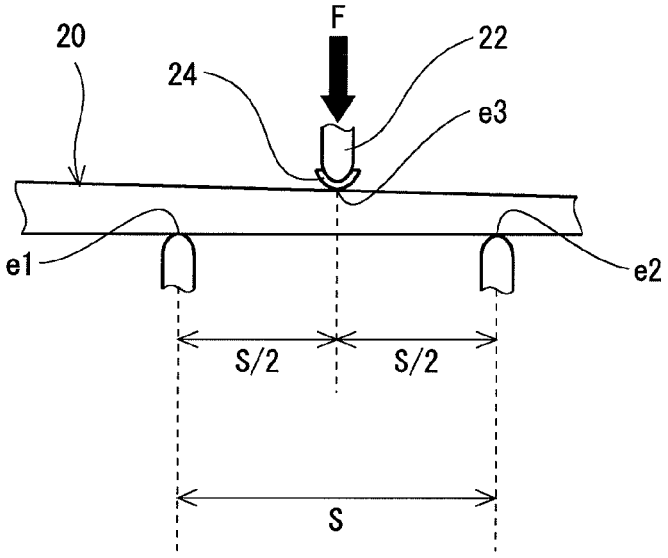
FIG. 7 shows a method for measuring a three-point flexural strength.

FIG. 7 shows a method for measuring a three-point flexural strength. As shown in FIG. 7, a load F is applied downward from above at a load point e3 while a shaft 20 is supported from below at two supporting points e1 and e2. The load point e3 is placed at a position bisecting the distance between the supporting points e1 and e2. The load point e3 is the measured point. When the point T is measured, the span S is set to 150 mm. When the point A, the point B, and the point C are measured, the span S is set to 300 mm. A value (peak value) of the load F when the shaft 20 is broken is measured.

In respect of durability, the three-point flexural strength of the point T is preferably equal to or greater than 150 kgf, and more preferably equal to or greater than 180 kgf. In order to increase the ratio of the center of gravity of the shaft, the weight of the tip part of the shaft is preferably suppressed. In this respect, the three-point flexural strength of the point T is preferably equal to or less than 350 kgf, and more preferably equal to or less than 300 kgf.

In respect of durability, the three-point flexural strength of the point A is preferably equal to or greater than 40 kgf, and more preferably equal to or greater than 50 kgf. In order to increase the ratio of the center of gravity of the shaft, the weight of the tip part of the shaft is preferably suppressed. In this respect, the three-point flexural strength of the point A is preferably equal to or less than 150 kgf, and more preferably equal to or less than 130 kgf.

In respect of durability, the three-point flexural strength of the point B is preferably equal to or greater than 40 kgf, and more preferably equal to or greater than 50 kgf. In respect of the weight saving of the shaft, the three-point flexural strength of the point B is preferably equal to or less than 150 kgf, and more preferably equal to or less than 130 kgf.

In respect of durability, the three-point flexural strength of the point C is preferably equal to or greater than 50 kgf, and more preferably equal to or greater than 55 kgf. In respect of the weight saving of the shaft, the three-point flexural strength of the point C is preferably equal to or less than 200 kgf, and more preferably equal to or less than 180 kgf.

[Club Length X]

In respect of enhancing the head speed, a club length X is preferably longer. On the other hand, in respect of a meet rate, the club length X is preferably shorter. The meet rate is the probability that a ball hits a sweet area of the head. In the case of a driver (1-wood), the club length X may be equal to or greater than 46 inch. In respect of the meet rate, the club length X is preferably less than 46 inch, more preferably equal to or less than 45.75 inch, and still more preferably equal to or less than 45.5 inch. Since the shaft has a large ratio of the center of gravity of the shaft, the shaft can attain a high head speed even if the club length is short. In respect of the flexure of the shaft enhancing the head speed, the club length X is preferably equal to or greater than 44 inch, more preferably equal to or greater than 44.5 inch, still more preferably equal to or greater than 45 inch, and yet still more preferably equal to or greater than 45.25 inch. An error of ±0.1 inch is observed in the club length X.

The club length in the present application is measured based on "1c Length" in "1 Clubs" of the Golf Rules "Appendix II Design of Clubs" defined by R&A (Royal and Ancient Golf Club of Saint Andrews).

The loft of the driver head is usually 8 degrees or greater and 13 degrees or less. In respect of the moment of inertia of the head, the volume of the driver head is preferably equal to or greater than 400 cc, and more preferably equal to or greater than 420 cc. In respect of the golf rules, the volume of the driver head is preferably equal to or less than 470 cc. The present invention is particularly effective in the driver (1-wood).

[Club Weight Y]

In respect of the easiness to swing, a club weight Y is preferably equal to or less than 300 g, more preferably equal to or less than 290 g, and still more preferably equal to or less than 285 g. In respect of the strength of the shaft and the head, the club weight is preferably equal to or greater than 250 g, more preferably equal to or greater than 260 g, and still more preferably equal to or greater than 270 g.

[Moment of Inertia MI of Club around Grip End (Moment of Inertia of Club)]

A rotation axis passing through a grip end (the back end of the club) and being perpendicular to the axis direction of the shaft is considered. The moment of inertia MI ($g \cdot cm^2$) of the club around the rotation axis can be calculated by the following formula.

$$MI=(T^2 \cdot M \cdot g \cdot H)/4\pi^2$$

T is a pendulum motion cycle (second) with the grip end as a center; M is a club weight (g); H is a distance (cm) between the grip end and the center of gravity of the club, and g is a gravitational acceleration.

The excessive weight saving reduces the strength. The excessive weight saving of the head reduces a coefficient of restitution. In this respect, the moment of inertia MI is preferably equal to or greater than $240\times10^4$ ($g \cdot cm^2$), and more preferably equal to or greater than $250\times10^4$ ($g \cdot cm^2$). In respect of the easiness to swing and the head speed, the moment of inertia MI is preferably equal to or less than $320\times10^4$ ($g \cdot cm^2$), and more preferably equal to or less than $310\times10^4$ ($g \cdot cm^2$).

[Swing Balance (14-Inch Type)]

The excessive weight saving of the head reduces the coefficient of restitution. In this respect, the swing balance is preferably equal to or greater than C9, and more preferably equal to or greater than D0. In respect of the easiness to swing and the head speed, the swing balance is preferably equal to or less than D5, and more preferably equal to or less than D4.

In addition to an epoxy resin, a thermosetting resin other than the epoxy resin and a thermoplastic resin or the like may be also used as the matrix resin of the prepreg sheet. In respect of the shaft strength, the matrix resin is preferably the epoxy resin.

The following Table 1 shows examples of the prepregs capable of being used for the shaft of the present invention.

TABLE 1

Examples of prepregs capable of being used

| | | | | | Physical property value of carbon fiber | | |
|---|---|---|---|---|---|---|---|
| Manufacturer | Part number of prepreg | Thickness of sheet (mm) | Fiber content (% by mass) | Resin content (% by mass) | Part number of carbon fiber | Tensile elastic modulus ($t/mm^2$) | Tensile strength ($kgf/mm^2$) |
| Toray Industries, Inc. | 3255S-10 | 0.082 | 76 | 24 | T700S | 23.5 | 500 |
| Toray Industries, Inc. | 3255S-12 | 0.103 | 76 | 24 | T700S | 23.5 | 500 |
| Toray Industries, Inc. | 3255S-15 | 0.123 | 76 | 24 | T700S | 23.5 | 500 |
| Toray Industries, Inc. | 805S-3 | 0.034 | 60 | 40 | M30S | 30 | 560 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |
| Nippon Graphite Fiber Corporation | E1026A-09N | 0.100 | 63 | 37 | XN-10 | 10 | 190 |
| Mitsubishi Rayon Co., Ltd. | TR350C-100S | 0.083 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | MR350C-075S | 0.063 | 75 | 25 | MR40 | 30 | 450 |
| Mitsubishi Rayon Co., Ltd. | MR350C-100S | 0.085 | 75 | 25 | MR40 | 30 | 450 |

TABLE 1-continued

| Examples of prepregs capable of being used | | | | | | | |
|---|---|---|---|---|---|---|---|
| | | | | | Physical property value of carbon fiber | | |
| Manufacturer | Part number of prepreg | Thickness of sheet (mm) | Fiber content (% by mass) | Resin content (% by mass) | Part number of carbon fiber | Tensile elastic modulus (t/mm$^2$) | Tensile strength (kgf/mm$^2$) |
| Mitsubishi Rayon Co., Ltd. | MR350C-125S | 0.105 | 75 | 25 | MR40 | 30 | 450 |
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |
| Mitsubishi Rayon Co., Ltd. | HRX350C-110S | 0.082 | 75 | 25 | HR40 | 40 | 450 |

A tensile strength and a tensile elastic modulus are values measured in accordance with JIS R7601:1986 "Testing Method for Carbon Fibers".

EXAMPLES

Hereinafter, the effects of the present invention will be clarified by examples. However, the present invention should not be interpreted in a limited way based on the description of examples.

[Test 1]

Golf clubs of examples 1-1 to 1-4 and comparative examples 1-1 to 1-8 were produced, and these were evaluated. Heads having the same shape were used for all the golf clubs. The volume of the head was 460 cc, and the material of the head was a titanium alloy. A club length, a head weight, and a grip weight were adjusted so that desired specifications were obtained. For example, the grip weight of example 1-3 was 38 g.

Shafts according to examples 1-1 to 1-4 were produced based on a developed view of FIG. 2 or 5. A manufacturing method was the same as that of the shaft 6. For each sheet, the number of windings, the thickness of a prepreg, the fiber content of the prepreg, and the tensile elastic modulus of a carbon fiber, or the like were suitably selected. "E1026A-09N" was used for a butt partial layer in all the examples.

For example, example 1-3 was produced using the following materials based on the developed view of FIG. 2.

Figure 8:
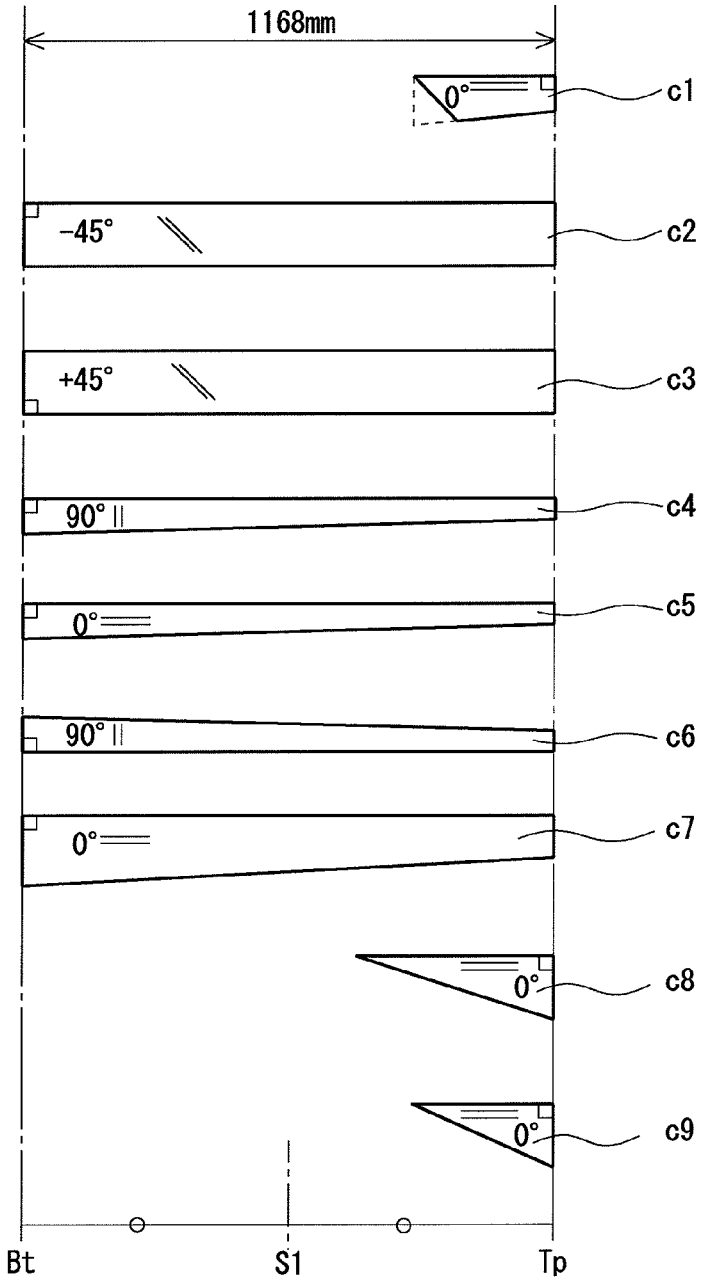
FIG. 8 shows an example of a developed view of a shaft according to a comparative example.

Sheet a1: TR350C-125S
Sheet a2: HRX350C-075S
Sheet a3: HRX350C-075S
Sheet a4: 805S-3
Sheet a5: E1026A-09N
Sheet a6: E1026A-09N
Sheet a7: TR350C-100S
Sheet a8: TR350C-100S
Sheet a9: 805S-3
Sheet a10: MR350C-100S
Sheet a11: TR350C-100S
Sheet a12: TR350C-100S An example of the developed view of a shaft according to comparative example is shown in FIG. 8. Shafts according to comparative examples 1-1 to 1-8 were produced based on the developed view of FIG. 8. A manufacturing method was the same as that of the shaft 6. For each sheet, the number of windings, the thickness of a prepreg, the fiber content of the prepreg, and the tensile elastic modulus of a carbon fiber, or the like were suitably selected. For example, comparative example 1-2 was produced using the following materials based on the developed view of FIG. 8.

Sheet c1: TR350C-125S
Sheet c2: HRX350C-075S
Sheet c3: HRX350C-075S
Sheet c4: 805S-3
Sheet c5: TR350C-100S
Sheet c6: 805S-3
Sheet c7: MR350C-100S
Sheet c8: TR350C-100S
Sheet c9: TR350C-100S The specifications and the evaluation results of examples 1-1 to 1-4 are shown in the following Table 2. The specifications and the evaluation results of comparative examples 1-1 to 1-8 are shown in the following Table 3.

TABLE 2

| Specifications and evaluation results of examples (test 1) | | | | | |
|---|---|---|---|---|---|
| | Unit | Example 1-1 | Example 1-2 | Example 1-3 | Example 1-4 |
| Club length X | inch | 46.5 | 45.75 | 45.5 | 45.25 |
| Club weight Y | g | 265 | 278 | 280 | 281.8 |
| Shaft weight Ws | g | 39 | 47 | 48 | 49 |
| Ratio of center of gravity of shaft | % | 54 | 54 | 54 | 54 |
| Wa/Wb | | 0.45 | 0.47 | 0.47 | 0.47 |
| Swingweight | | D1 | D1 | D1 | D1 |
| Easiness to swing (five-point scale) | point | 4 | 5 | 5 | 5 |
| B/S | m/s | 65 | 64.5 | 64.3 | 64 |
| Total flight distance | yard | 257 | 255 | 252 | 250 |
| Lateral deviation amount | yard | 12 | 2 | 1 | 1 |

TABLE 3

| Specifications and evaluation results of comparative examples (test 1) | | | | | | | | | |
|---|---|---|---|---|---|---|---|---|---|
| | | Comparative example 1-1 | Comparative example 1-2 | Comparative example 1-3 | Comparative example 1-4 | Comparative example 1-5 | Comparative example 1-6 | Comparative example 1-7 | Comparative example 1-8 |
| Club length X | inch | 47 | 47 | 46 | 46 | 45 | 45 | 44 | 44 |
| Club weight Y | g | 280 | 265 | 300 | 255 | 310 | 265 | 300 | 285 |
| Shaft weight Ws | g | 55 | 50 | 65 | 48 | 70 | 53 | 65 | 60 |
| Ratio of center of gravity of shaft | % | 50 | 50 | 50 | 50 | 50 | 50 | 50 | 50 |

TABLE 3-continued

Specifications and evaluation results of comparative examples (test 1)

| | | Comparative example 1-1 | Comparative example 1-2 | Comparative example 1-3 | Comparative example 1-4 | Comparative example 1-5 | Comparative example 1-6 | Comparative example 1-7 | Comparative example 1-8 |
|---|---|---|---|---|---|---|---|---|---|
| Wa/Wb | | 0.34 | 0.35 | 0.33 | 0.37 | 0.33 | 0.37 | 0.34 | 0.35 |
| Swingweight | | D1 | D1 | D1 | D1 | D1 | D1 | D1 | D1 |
| Easiness to swing (five-point scale) | point | 3 | 3 | 3 | 3 | 3 | 3 | 3 | 3 |
| B/S | m/s | 63.5 | 63.7 | 63.5 | 64 | 62.5 | 63.5 | 62 | 62.3 |
| Total flight distance | yard | 246 | 248 | 245 | 249 | 240 | 245 | 232 | 233 |
| Lateral deviation amount | yard | 15 | 17 | 10 | 6 | 4 | 3 | 3 | 3 |

[Test 2]

Golf clubs of example 2-1 to 2-20 and comparative examples 2-1 to 2-3 were produced, and these were evaluated. Heads having the same shape were used for all the golf clubs. The volume of the head was 460 cc, and the material of the head was a titanium alloy. A club length was set to 45.5 inch in all the clubs. A head weight and a grip weight were adjusted so that desired specifications were obtained.

Shafts according to example 2-1 to 2-20 were produced based on a developed view of FIG. 2 or 5. A manufacturing method was the same as that of the shaft 6. For each sheet, the number of windings, the thickness of a prepreg, the fiber content of the prepreg, and the tensile elastic modulus of a carbon fiber, or the like were suitably selected. "E1026A-09N" was used for a butt partial layer in all the examples. One or more means selected from the above-mentioned items (a1) to (a8) were used in order to adjust the ratio of the center of gravity of the shaft.

Shafts according to comparative example 2-1 to 2-3 were produced based on a developed view of FIG. 8. A manufacturing method was the same as that of the shaft 6. For each sheet, the number of windings, the thickness of a prepreg, the fiber content of the prepreg, and the tensile elastic modulus of a carbon fiber, or the like were suitably selected.

The specifications and the evaluation results of examples 2-1 to 2-10 are shown in the following Table 4. The specifications and the evaluation results of examples 2-11 to 2-20 are shown in the following Table 5. The specifications and the evaluation results of comparative examples 2-1 to 2-3 are shown in the following Table 6.

TABLE 4

Specifications and evaluation results of examples (test 2)

| | Unit | Example 2-1 | Example 2-2 | Example 2-3 | Example 2-4 | Example 2-5 | Example 2-6 | Example 2-7 | Example 2-8 | Example 2-9 | Example 2-10 |
|---|---|---|---|---|---|---|---|---|---|---|---|
| Shaft weight Ws | g | 52 | 52 | 52 | 52 | 52 | 49 | 49 | 49 | 49 | 49 |
| Ratio of center of gravity of shaft | % | 65 | 58 | 54 | 53 | 52 | 65 | 58 | 54 | 53 | 52 |
| Forward flex F1 | mm | 145 | 142 | 139 | 137 | 135 | 150 | 147 | 145 | 143 | 140 |
| Flex point ratio C1 | % | 52 | 50 | 48 | 47 | 46 | 51 | 49 | 47 | 46 | 45 |
| Wa/Wb | | 0.55 | 0.47 | 0.43 | 0.39 | 0.38 | 0.57 | 0.49 | 0.45 | 0.41 | 0.40 |
| Three-point flexural strength (point T) | kgf | 210 | 215 | 220 | 226 | 231 | 200 | 205 | 210 | 215 | 220 |
| Three-point flexural strength (point B) | kgf | 78 | 83 | 87 | 92 | 98 | 75 | 80 | 85 | 90 | 95 |
| Easiness to swing (five-point scale) | point | 4 | 4 | 4 | 3 | 3 | 5 | 5 | 5 | 4 | 4 |
| B/S | m/s | 63.5 | 63 | 62.8 | 62.5 | 62 | 65 | 64.7 | 64.5 | 64.2 | 64 |
| Total flight distance | yard | 250 | 248 | 240 | 237 | 235 | 257 | 256 | 255 | 250 | 247 |
| Lateral deviation amount | yard | 3 | 2 | 1 | 1 | 1 | 5 | 3 | 2 | 2 | 2 |

TABLE 5

Specifications and evaluation results of examples (test 2)

| | Unit | Example 2-11 | Example 2-12 | Example 2-13 | Example 2-14 | Example 2-15 | Example 2-16 | Example 2-17 | Example 2-18 | Example 2-19 | Example 2-20 |
|---|---|---|---|---|---|---|---|---|---|---|---|
| Shaft weight Ws | g | 40 | 40 | 40 | 40 | 40 | 30 | 30 | 30 | 30 | 30 |
| Ratio of center of gravity of shaft | % | 65 | 58 | 54 | 53 | 52 | 65 | 58 | 54 | 53 | 52 |
| Forward flex F1 | mm | 160 | 155 | 150 | 147 | 145 | 180 | 178 | 175 | 173 | 170 |
| Flex point ratio C1 | % | 49 | 48 | 47 | 46 | 45 | 47 | 46 | 45 | 44 | 43 |
| Wa/Wb | | 0.59 | 0.51 | 0.47 | 0.43 | 0.42 | 0.60 | 0.52 | 0.47 | 0.43 | 0.42 |
| Three-point flexural strength (point T) | kgf | 190 | 195 | 200 | 205 | 210 | 150 | 155 | 160 | 165 | 170 |

TABLE 5-continued

Specifications and evaluation results of examples (test 2)

| | Unit | Example 2-11 | Example 2-12 | Example 2-13 | Example 2-14 | Example 2-15 | Example 2-16 | Example 2-17 | Example 2-18 | Example 2-19 | Example 2-20 |
|---|---|---|---|---|---|---|---|---|---|---|---|
| Three-point flexural strength (point B) | kgf | 65 | 70 | 75 | 80 | 85 | 40 | 45 | 50 | 55 | 60 |
| Easiness to swing (five-point scale) | point | 5 | 5 | 5 | 4 | 4 | 4 | 4 | 3 | 3 | 3 |
| B/S | m/s | 66 | 65.8 | 65.6 | 65.3 | 65 | 67.5 | 67.3 | 67 | 66 | 65.8 |
| Total flight distance | yard | 260 | 258 | 256 | 254 | 251 | 265 | 263 | 260 | 257 | 255 |
| Lateral deviation amount | yard | 10 | 8 | 7 | 5 | 4 | 13 | 10 | 8 | 6 | 5 |

TABLE 6

Specifications and evaluation results of comparative examples (test 2)

| | Unit | Comparative example 2-1 | Comparative example 2-2 | Comparative example 2-3 |
|---|---|---|---|---|
| Shaft weight Ws | g | 60 | 52 | 40 |
| Ratio of center of gravity of shaft | % | 50 | 50 | 50 |
| Forward flex F1 | mm | 130 | 140 | 145 |
| Flex point ratio C1 | % | 44 | 44 | 44 |
| Wa/Wb | | 0.33 | 0.34 | 0.33 |
| Three-point flexural strength (point T) | kgf | 230 | 220 | 215 |
| Three-point flexural strength (point B) | kgf | 102 | 100 | 80 |
| Easiness to swing (five-point scale) | point | 3 | 2 | 2 |
| B/S | m/s | 60.5 | 60.5 | 61.5 |
| Total flight distance | yard | 227 | 228 | 215 |
| Lateral deviation amount | yard | 1 | 1 | 3 |

[Evaluation Methods]

[Forward Flex F1, Backward Flex F2, Flex Point Ratio C1 of Shaft]

A forward flex F1 and a backward flex F2 were measured by the above-mentioned method. A flex point ratio C1 of the shaft was calculated by the above-mentioned calculation formula. The forward flex F1 and the flex point ratio C1 of the shaft are shown in Tables.

[Easiness to Swing]

Ten golf players evaluated easiness to swing in five stages. The evaluation is sensuous evaluation. The highest evaluation was defined as five points, and the lowest evaluation was defined as one point. Ten golf players' average points (the figures below the decimal point are rounded off) are shown in Tables.

[B/S]

B/S is initial velocity of a ball. The ten golf players hit balls five times to obtain fifty data. The average values of these data are shown in Tables.

[Total Flight Distance]

A total flight distance is a flight distance including run. The ten golf players hit balls five times to obtain fifty data. The average values of these data are shown in Tables.

[Wa/Wb]

As described above, the range from the point P2 to the butt end Bt is defined as the specific butt range. The weight of the butt partial layer existing in the specific butt range is defined as Wa, and the weight of the shaft in the specific butt range is defined as Wb. Ratios (Wa/Wb) are shown in Tables.

[Lateral Deviation Amount]

A lateral deviation amount is deviation from the target direction. The deviation amount is a distance between a straight line connecting a hit ball point to a target point and a hit ball reaching point. The deviation amount is a plus value in both cases where the ball is deviated to both a right side and a left side. The ten golf players hit balls five times to obtain fifty data. The average values of these data are shown in Tables. The less the lateral deviation amount is, the higher directional stability is.

As shown in these graphs and Tables, the advantages of the present invention are apparent.

The shaft described above can be applied to all golf clubs.

The description hereinabove is merely for an illustrative example, and various modifications can be made in the scope not to depart from the principles of the present invention.

What is claimed is:

1. A golf club shaft having a tip end and a butt end with a butt partial layer, wherein if the shaft full length is defined as Ls and a distance between a tip end of the shaft and a center of gravity G of the shaft is defined as Lg, then Lg/Ls is 0.52 or greater and 0.65 or less;

a shaft weight is equal to or less than 52 g; and wherein if a point separated by 250 mm from the butt end Bt is defined as P2; a range from the point P2 to the butt end Bt is defined as a specific butt range; a weight of the butt partial layer existing in the specific butt range is defined as Wa grams; and a weight of the shaft in the specific butt range is defined as Wb grams, then Wa/Wb is equal to or greater than 0.4.

2. The golf club shaft according to claim 1, wherein the shaft weight is equal to or less than 50 g.

3. The golf club shaft according to claim 1, wherein a fiber elastic modulus of the butt partial layer is equal to or less than 20 t/mm$^2$.

4. The golf club shaft according to claim 1, wherein a fiber elastic modulus of the butt partial layer is equal to or less than 20 t/mm$^2$.

5. The golf club shaft according to claim 1, wherein the shaft full length Ls is equal to or greater than 42 inch.

6. The golf club shaft according to claim 1, wherein the shaft full length Ls is equal to or less than 47 inch.

7. The golf club shaft according to claim 1, wherein the shaft weight is equal to or greater than 30 g.

8. The golf club shaft according to claim 1, wherein a weight of the butt partial layer is 5% by weight or greater and 50% by weight or less based on the shaft weight.

9. The golf club shaft according to claim 1, wherein a fiber elastic modulus of the butt partial layer is equal to or greater than 5 t/mm$^2$.

10. The golf club shaft according to claim 1, wherein a resin content of the butt partial layer is 20% by weight or greater and 50% by weight or less.

11. The golf club shaft according to claim 1, wherein if a point separated by 250 mm from a butt end Bt is defined as P2, and a range from the point P2 to the butt end Bt is defined as a specific butt range, the shaft outer diameter in the specific butt range is 11 mm or greater and 17 mm or less.

12. The golf club shaft according to claim 1, wherein if a point separated by 250 mm from a butt end Bt is defined as P2, and a range from the point P2 to the butt end Bt is defined as a specific butt range, the shaft thickness in the specific butt range is 0.4 mm or greater and 1.3 mm or less.

13. The golf club shaft according to claim 1, wherein a forward flex F1 is 125 mm or greater and 155 mm or less.

14. The golf club shaft according to claim 1, wherein a backward flex F2 is 118 mm or greater and 145 mm or less.

15. The golf club shaft according to claim 1, wherein a flex point ratio C1 of the shaft is 38% or greater and 50% or less.

16. The golf club shaft according to claim 1, wherein Lg/Ls is equal to or greater than 0.54.

17. The golf club shaft according to claim 1, wherein the shaft weight is equal to or less than 49 g.

18. The golf club shaft according to claim 1, wherein the shaft weight is less than 50 g.

* * * * *